United States Patent [19]

Williams et al.

[11] Patent Number: 4,867,687

[45] Date of Patent: Sep. 19, 1989

[54] ELECTRICAL ELBOW CONNECTION

[75] Inventors: Danny R. Williams, Houston; Carl J. Wentzel, Austin, both of Tex.

[73] Assignee: Houston Industries Incorporated, Houston, Tex.

[21] Appl. No.: 307,625

[22] Filed: Feb. 6, 1989

Related U.S. Application Data

[63] Continuation-in-part of Ser. No. 212,961, Jun. 29, 1988, which is a continuation of Ser. No. 933,570, Nov. 21, 1986, abandoned.

[51] Int. Cl.[4] ..... H01R 35/00

[52] U.S. Cl. ..... 439/10; 439/921

[58] Field of Search ..... 439/10, 32, 88, 181, 439/271, 281, 921, 89

[56] References Cited

U.S. PATENT DOCUMENTS 2,422,961 6/1947 Hallstrand .
3,617,986 11/1971 Becker et al. .
3,835,439 9/1974 Yonkers ..... 439/281 X

*Primary Examiner*—Z. R. Bilinsky
*Attorney, Agent, or Firm*—Pravel, Gambrell, Hewitt, Kimball & Krieger

[57] ABSTRACT

An electrical elbow connection between a high voltage cable and a conductive bushing on a piece of electrical power distribution equipment, such as a transformer, is provided with a telescoping, rotating connector. This allows relative movement between the probe and the cable, which facilitates connecting the elbow to the bushing and allows for relative movement between the two over their service life.

14 Claims, 2 Drawing Sheets

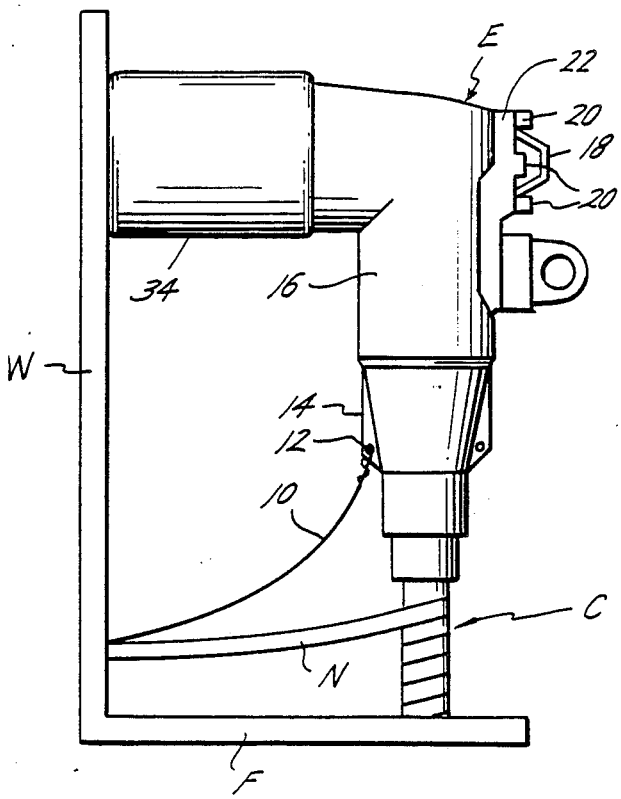
Fig. 1
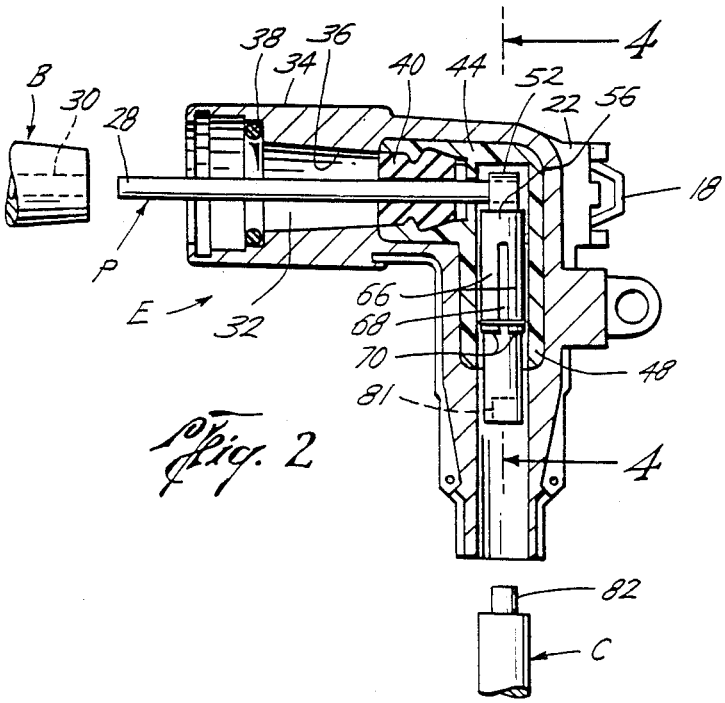
Fig. 2
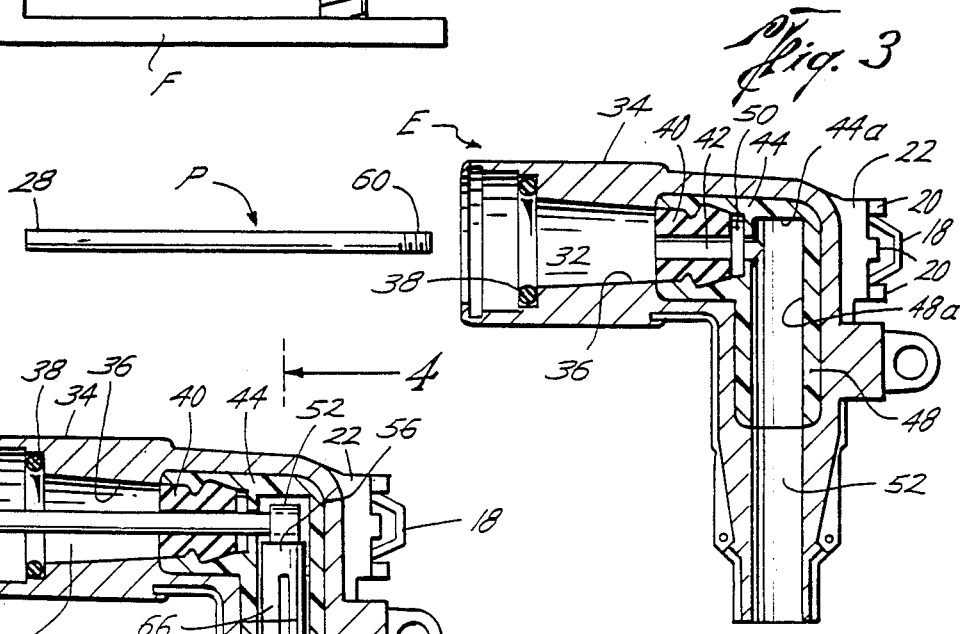
Fig. 3
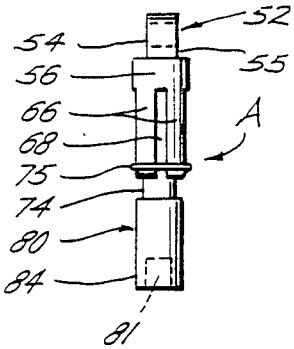

ELECTRICAL ELBOW CONNECTION

CROSS-REFERENCE TO RELATED APPLICATIONS

The present application is a continuation-in-part of co-pending U.S. patent application Ser. No. 212,961 filed June 29, 1988, which is a continuation of U.S. patent application Ser. No. 933,570 filed Nov. 21, 1986, now abandoned.

BACKGROUND OF THE INVENTION

1. Field of Invention

The present invention relates to connectors for making connection between items of electrical power distribution equipment.

2. Description of Prior Art

Electrical elbows are used to connect high voltage power cables to bushings on high power electrical equipment. So far as is known, in the past these elbows have been rigid and unitary in construction. The elbow contains a conductive probe which is adapted to fit in a conductive socket in the bushing. The unitary elbow has suffered from installation problems in the past because of the difficulty of aligning the probe and socket. Further, the electrical equipment on which the bushing is mounted was usually mounted on a support pad. The support pad often experienced slight changes in position during its service life due to settling and the like. Due to the stiffness of the cable, this has subjected the connection between the probe and bushing to mechanical stresses, which will eventually cause a failure.

SUMMARY OF INVENTION

Briefly, the present invention provides a new and improved electrical elbow connection. It is particularly adapted for use in connecting high voltage power cables to electrical equipment such as power transformers and the like.

In an elbow connection according to the present invention, a conductive probe in an electrical elbow connector is used to make electrical connection between a power cable and a bushing on electrical power distribution equipment. A contact head receives an end of the conductive probe in the elbow connector. An end of the power cable is received in a conductive sleeve in the elbow connector. According to the present invention, structure is provided to functionally permit relative movement between the contact head and the conductive sleeve, and thus between the conductive probe and power cable. The relative movement permitted can be either rotational or telescoping, and is thus three-dimensional.

Structurally, the present invention provides a body member which has the contact head mounted with it and has a receptor sleeve formed extending on an opposite side from the contact head. A piston member formed extending from the conductive sleeve is movably mounted in the receptor sleeve.

BRIEF DESCRIPTION OF THE DRAWINGS

FIG. 1 is an elevation view of an electrical elbow connection.

FIG. 2 is a partially exploded, cross-sectional view on an electrical elbow connection according to the present invention.

FIG. 3 is an exploded view of a portion of the electrical elbow connector of FIG. 2.

DESCRIPTION OF PREFERRED EMBODIMENT

Figure 4:
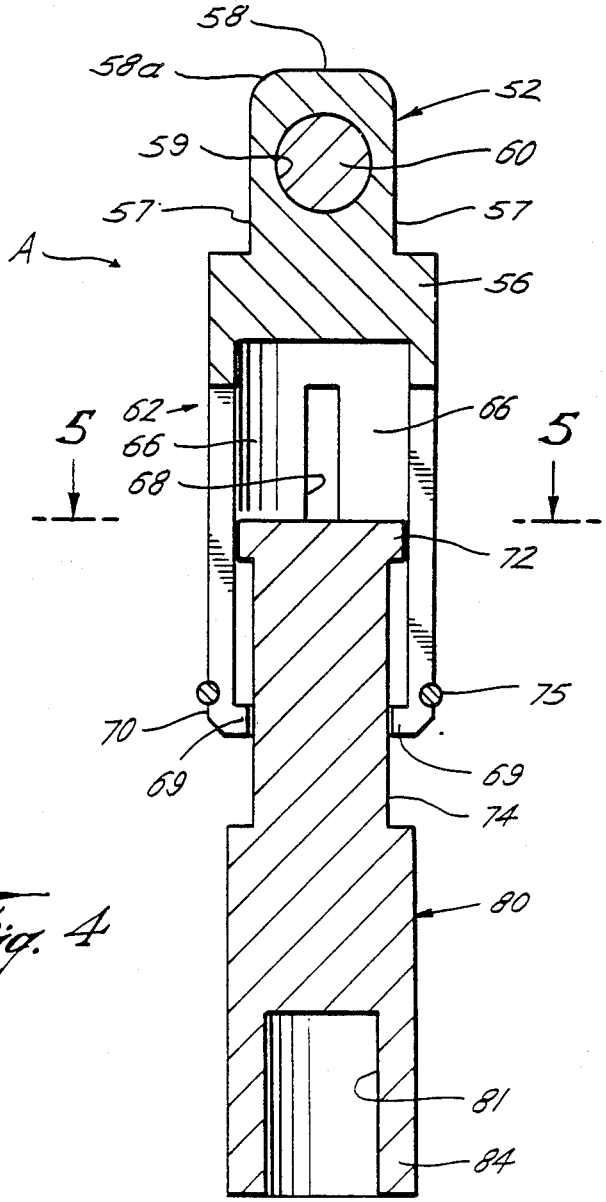
FIG. 4 is an enlarged, cross-sectional view taken along the lines 4—4 of FIG. 2.

In the drawings, the letter E designates generally an electrical elbow connection between a conductive bushing B on a wall W of a piece of high voltage electrical distribution equipment, such as a transformer, and a high voltage distribution cable C. In the embodiment shown, the cable C extends upwardly through a support pad or foundation F for the electrical equipment. It should be understood, however, that the elbow connection E and the bushing may be at any of a number of angles with respect to each other, depending upon the location where the connection is to be made, such as underground and the like.

As is typical for support pad usage, the elbow E is provided with a grounding wire 10 connected between the power distribution equipment and an eyelet 12 formed in the electrical elbow on a cable housing section 16 of the elbow E. Also, as is typical, a concentric neutral conductor N from the power cable C is also electrically connected to the power distribution equipment. Further, the elbow E is provided with connecting structure in the form of a raised coupling bracket 18 mounted between raised lugs 20 of an end cap 22 so that the elbow connection E can be made or broken using suitable installing tools. In the elbow connection E, the electrical connection is made by installing a tip 28 of a conductive probe P into a correspondingly sized socket 30 formed in the bushing B.

In the electrical elbow connector E, the conductive probe P is mounted in a hollow central pocket 32 formed in an upper cup portion 34. A mating inner surface 36 is formed in the cup 34 adjacent the pocket 32 and is adapted to sealingly engage corresponding surfaces formed on the bushing B. An O-ring seal 38 is provided on the inner surface 36 of the cup 34 for sealing purposes. A sealing socket 40 is mounted in the cup 34 at an inner end and has a central passage port 42 formed therein for passage of the body of the probe P. The sealing socket 40 is mounted in an inwardly extending upper end 44 of an L-shaped, semiconducting insert sleeve 48. A washer 50 is mounted between the sealing socket 40 and insert sleeve 48.

Figure 5:
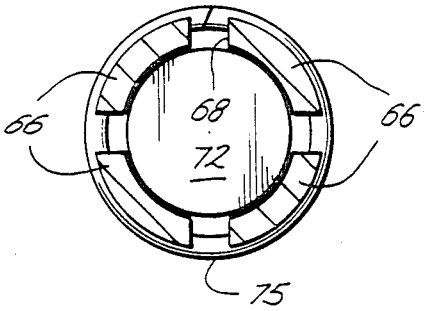
FIG. 5 is a cross-sectional view taken along the lines 5—5 of FIG. 4.

In the electrical elbow connector E, a connector apparatus A (FIGS. 5) according to the present invention is provided to fit within a central upwardly extending tube or socket 51 in the insert sleeve 48 and connect the probe P to the cable C. The apparatus A includes a contact head 52 having a flat front surface 54 (FIG. 3) and a flat rear surface 55 extending upwardly from a body member 56. Arcuate side surfaces 57 (FIG. 4) extend between flat surfaces 54 and 55 of the contact head 52. A top portion 58 of the contact head is rounded at surfaces **58*a* for providing clearance from an upper wall 44*a* (FIG. 3) of the upper end 44 of insert sleeve 48 for relative movement. Further, the body member 56 is provided clearance space (FIG. 2) from inner walls 48*a* of insert sleeve 48** for like reasons.

The contact head 52 has a threaded contact socket 59 (FIGS. 3 & 4) formed in it extending between surfaces 54 and 55 for receipt of and connection with a correspondingly threaded inner end surface 60 (FIG. 3) of the probe P. A receptor sleeve 62 (FIG. 4) is formed extending downwardly from the body member 56 in a direction opposite the contact head 52. The receptor sleeve 62 in the preferred embodiment of the present invention takes the form of a plurality of downwardly extending spaced fingers 66 spaced from each other by slots 68. Inwardly extending stop lugs 69 are formed at lower end portions 70 of each of the fingers 66 and are adapted to engage an enlarged stopping head 72 formed at an upper end of a piston member 74.

The stop head 72 is in physical contact with, but is relatively movable within the receptor sleeve 62 both vertically and telescopingly, as well as rotationally, subject to travel limits imposed by the size of receptor sleeve 62. In this manner, electrical connection is maintained between the probe P and cable C even when there is relative three-dimensional movement of the piston member 74 and stop head 72 within the receptor sleeve 62.

If desired, the lugs 69 may each have a tapered upper surface 69*a* which engages a co-acting lower surface 72*a* on stop head 72 to retain the stopping head 72 in receptor sleeve 62. A snap ring 75 or other suitable resilient means is provided in a groove 76 about the lower end portions 70 of the fingers 66 to limit relative outward movement of the spaced fingers 66 of the receptor sleeve 62 and also to assist in retaining the stopping head 72 within the receptor sleeve 62.

The piston member 74 extends upwardly from a connector cup 80 which has an inwardly extending socket 81 formed therein for receipt of a bare end 82 (FIG. 2) of the cable C. When the conductor portion of the end of the cable 82 has been firmly inserted into the connector cup 80, lower end portions 84 of the connector cup 80 are firmly crimped onto the conductor portion of the end of the cable 82, connecting the apparatus A to the cable C. The flat face 54 on the contact 52 is then moved so that it faces perpendicularly to the axis of insertion of the probe P, and the apparatus A inserted its full extent into the sleeve 51 of insulative insert sleeve 48. The probe P is then inserted into the central pocket 32 of the elbow connector E and through the sealing socket 40 until contact is made with the contact socket 58 of the contact head 52. At this point, the threaded end 60 of the probe P is inserted into the threaded contact socket 58 of the contact head 52 and probe P is rotated, threading the surfaces 59 and 60 together until firm connection has been made.

The elbow E is then moved toward the bushing B with the end 28 of the probe P aligned with the socket 30 of the bushing B. Should there be any slight misalignment between the probe P and the socket 30, the probe P may be moved either vertically or horizontally to the extent required for accurate axial alignment between the probe P and the socket 30 of the bushing B. During this movement, the piston member 74 provides relative movement, but maintains electrical connection through stop head 72, between the contact head 52 and the connector cup 80, in that it is rotatable, thereby providing relative rotational movement between the probe P and the bushing B. Further, the piston member 74 is vertically and telescopingly movable within the receptor sleeve 62 along their respective longitudinal axes, providing relative movement between the probe P and the bushing B, but with continuing electrical connection between the probe P and cable C. In this manner, three-dimensional movement for alignment purposes is permitted with maintained electrical conduction.

In this manner, relative movement between the probe P and bushing B is permissible in either direction horizontally because of the rotational movement of the piston 74 and receptor sleeve 62. Further, vertical movement between the probe P and the bushing B to align them is permitted due to the sliding vertical movement of the piston 74 within the receptor sleeve 62. Thus, the probe P and bushing B may be move in three dimensions to compensate for any possible misalignment during initial connection of the cable C through the elbow E to the bushing B. Further, during the service life of the elbow E, any slight relative movement between the cable C and the pad F or wall W, due to settling of the earth or other effects, is adjusted for by the relative movement with continuing electrical connection afforded by the apparatus A according to the present invention. Additionally, if the initial high voltage distribution equipment is to be replaced after use in service, alignment of the already installed elbow E and the bushing B of the new equipment affords no problem, due to the relative movement possibilities afforded by the apparatus A.

The foregoing disclosure and description of the invention are illustrative and explanatory thereof, and various changes in the size, shape and materials, as well as in the details of the illustrated construction may be made without departing from the spirit of the invention.

We claim:

1. In an electrical elbow connector having a conductive probe for making an electrical connection between a high voltage cable and a bushing on electrical power distribution equipment, the improvement comprising:

(a) a body member;

(b) contact head means extending from said body member for receiving an end of the conductor probe;

(c) a receptor sleeve extending from said body member opposite said contact head means;

(d) conductive sleeve means, including connector cup means, for receiving an end of the power cable;

(e) a piston member extending from said conductive sleeve means;

(f) said piston member having an enlarged stopping head formed thereon;

(g) said piston member being vertically and telescopingly movable in said receptor sleeve while maintaining electrical contact therebetween; and (h) said piston member being rotatably movable in said receptor sleeve while maintaining electrical contact therebetween.

2. The structure of claim 1 further including:

stop means for retaining said piston member in said receptor sleeve.

3. The structure of claim 2, wherein said stop means comprises:

stopping lugs extending inwardly from said receptor sleeve for engaging said stopping head.

4. The structure of claim 1, wherein said receptor sleeve comprises:

a plurality of spaced fingers extending from said body member forming a pocket for receiving said piston member.

5. The structure of claim 4, further comprising:

stop means for retaining said piston member in said receptor sleeve.

6. The structure of claim 5, wherein said stop means comprises:

stopping lugs extending inwardly from said spaced fingers of said receptor sleeve for engaging said stopping head.

7. The structure of claim 6, wherein said stop means further comprises:

snap ring means for limiting relative movement of said spaced fingers of said receptor sleeve.

8. A connector apparatus for connecting a conductive probe of an electrical elbow connector to a high voltage power cable to make an electrical connection therebetween, comprising:

(a) a body member;

(b) contact head means extending from said body member for receiving an end of the conductor probe;

(c) a receptor sleeve extending from said body member opposite said contact head means;

(d) conductive sleeve means, including connector cup means, for receiving an end of the power cable;

(e) a piston member extending from said conductive sleeve means;

(f) said piston member having an enlarged stopping head formed thereon;

(g) said piston member being vertically and telescopingly movable in said receptor sleeve while maintaining electrical contact therebetween; and (h) said piston member being rotatably movable in said receptor sleeve while maintaining electrical contact therebetween.

9. The apparatus of claim 8, further including:

stop means for retaining said piston member in said receptor sleeve.

10. The apparatus of claim 9, wherein said stop means comprises:

stopping lugs extending inwardly from said receptor sleeve for engaging said stopping head.

11. The apparatus of claim 8, wherein said receptor sleeve comprises:

a plurality of spaced fingers extending from said body member forming a pocket for receiving said piston member.

12. The apparatus of claim 11, further comprising:

stop means for retaining said piston member in said receptor sleeve.

13. The apparatus of claim 12, wherein said stop means comprises:

stopping lugs extending inwardly from said spaced fingers of said receptor sleeve for engaging said stopping head.

14. The apparatus of claim 13, wherein said stop means further comprises:

snap ring means for limiting relative movement of said spaced fingers of said receptor sleeve.

* * * * *